US007182006B1

(12) United States Patent
Wu

(10) Patent No.: US 7,182,006 B1
(45) Date of Patent: Feb. 27, 2007

(54) TORQUE-CONTROLLING WRENCH

(75) Inventor: Yi-Min Wu, Fongyuan (TW)

(73) Assignee: Matatakitoyo Tool Co., Ltd., Taichung County (TW)

( * ) Notice: Subject to any disclaimer, the term of this patent is extended or adjusted under 35 U.S.C. 154(b) by 0 days.

(21) Appl. No.: 11/504,737

(22) Filed: Aug. 16, 2006

(51) Int. Cl.
*B25B 83/142* (2006.01)

(52) U.S. Cl. ..... 81/478; 73/862.23

(58) Field of Classification Search ..... 81/478, 81/483, 467, DIG. 5; 384/58; 73/862.23
See application file for complete search history.

(56) References Cited

U.S. PATENT DOCUMENTS 4,898,068 A * 2/1990 Neuhaus ..... 81/483
5,859,371 A * 1/1999 Hsieh ..... 73/862.23
7,111,532 B2 * 9/2006 Wu ..... 81/478

* cited by examiner

*Primary Examiner*—Jacob K. Ackun, Jr.
(74) *Attorney, Agent, or Firm*—Banger Shia

(57) ABSTRACT

A torque-controlling wrench includes a handle, a socket-driving unit installed on the handle and a torque-controlling device. The torque-controlling device includes a rod installed in the handle and connected to the socket-driving unit, a knob installed on the handle and a spring compressed between the rod and the knob so that the knob can be turned to adjust a force exerted on the rod by the spring. An intermediate mechanism includes a first roller connected to the rod, a frame connected to the spring, a wheel installed on the frame and engaged with the roller and a second roller installed on the frame and engaged with the wheel. The centers of the first and second rollers are located on a same side of a vertical line passing a center of the wheel.

4 Claims, 8 Drawing Sheets

TORQUE-CONTROLLING WRENCH

BACKGROUND OF INVENTION

1. Field of Invention

The present invention relates to a torque-controlling wrench and, more particularly, to a torque-controlling wrench with a spring that is compressed evenly, thus elongating the life thereof.

2. Related Prior Art

A torque-controlling wrench is used to protectively exert a controllable torque on a fastener such as a threaded bolt and a nut. When the torque exerted on the fastener reaches a pre-determined value, the driving of the fastener by the torque-controlling wrench is interrupted for avoiding excessive engagement of the thread of the threaded bolt with the thread of the nut, damage of the threads of the threaded bolt and nut and/or damage of the head of the threaded bolt or the nut. Hence, the threaded bolt can be disengaged from the nut.

Referring to FIGS. 1 through 4, there is shown a conventional torque-controlling wrench. The conventional torque-controlling wrench includes a handle 10 that is hollow, a socket-driving unit 15 installed at an end of the handle 10 and a torque-controlling device 20 installed in the handle 10 and connected to the socket-driving unit 15. The torque-controlling device 20 includes a rod 21 connected to the socket-driving unit 15, a knob 23 and a spring 22 compressed between the rod 21 and the knob 23 that can be turned to adjust the force exerted on the rod 21 by the spring 22. For the stability and precision of the contact of the rod 21 with the spring 22, there is generally an intermediate mechanism 24. The intermediate mechanism 24 includes a roller 25 installed at an end of the rod 21 and a rolling gear installed at an end of the spring 22. The rolling gear includes a frame 26 installed in the handle 10, a shaft 27 installed on the frame 26, a wheel 28 installed on the shaft 27 and a roller 29 installed on the frame 26. The center of the roller 25 is located on a side of a vertical line passing the center of the shaft 27 while the center of the roller 29 is located on the other side of the vertical line. As shown in FIG. 4, when torque exerted on a fastener by the torque-controlling wrench reaches a pre-determined value, the rod 21 will be moved downwards. The movement of the rod 21 is not supposed to cause the pivoting of the frame 26 due to the use of the roller 25 and the wheel 28 both of which are expected to roll smoothly. However, the roller 25 and the wheel 28 generally do not roll as smoothly as expected. The movement of the rod 21 causes the pivoting of the frame 26 in practice. When the frame 26 is pivoted, the spring 22 will be bent instead of compressed. Hence, the driving of the fastener by the torque-controlling wrench will not be interrupted as expected.

The present invention is therefore intended to obviate or at least alleviate the problems encountered in prior art.

SUMMARY OF INVENTION

The primary objective of the present invention is to provide a precise torque-controlling wrench.

According to the present invention, a torque-controlling wrench includes a handle, a socket-driving unit installed on the handle and a torque-controlling device. The torque-controlling device includes a rod installed in the handle and connected to the socket-driving unit, a knob installed on the handle and a spring compressed between the rod and the knob so that the knob can be turned to adjust a force exerted on the rod by the spring. An intermediate mechanism includes a first roller connected to the rod, a frame connected to the spring, a wheel installed on the frame and engaged with the roller and a second roller installed on the frame and engaged with the wheel. The centers of the first and second rollers are located on a same side of a vertical line passing a center of the wheel. As a torque exerted on a fastener by the wrench reaches a pre-determined value, the rod is moved vertically and horizontally relative to the handle. A downward force exerted on the wheel by the first roller is encountered by an upward force exerted on the wheel by the second roller without causing the pivoting of the frame.

Other objectives, advantages and features of the present invention will become apparent from the following description referring to the attached drawings.

BRIEF DESCRIPTION OF DRAWINGS

The present invention will be described through detailed illustration of the preferred embodiment in comparison with the prior art referring to the drawings.

DETAILED DESCRIPTION OF PREFERRED EMBODIMENT

Figure 1:
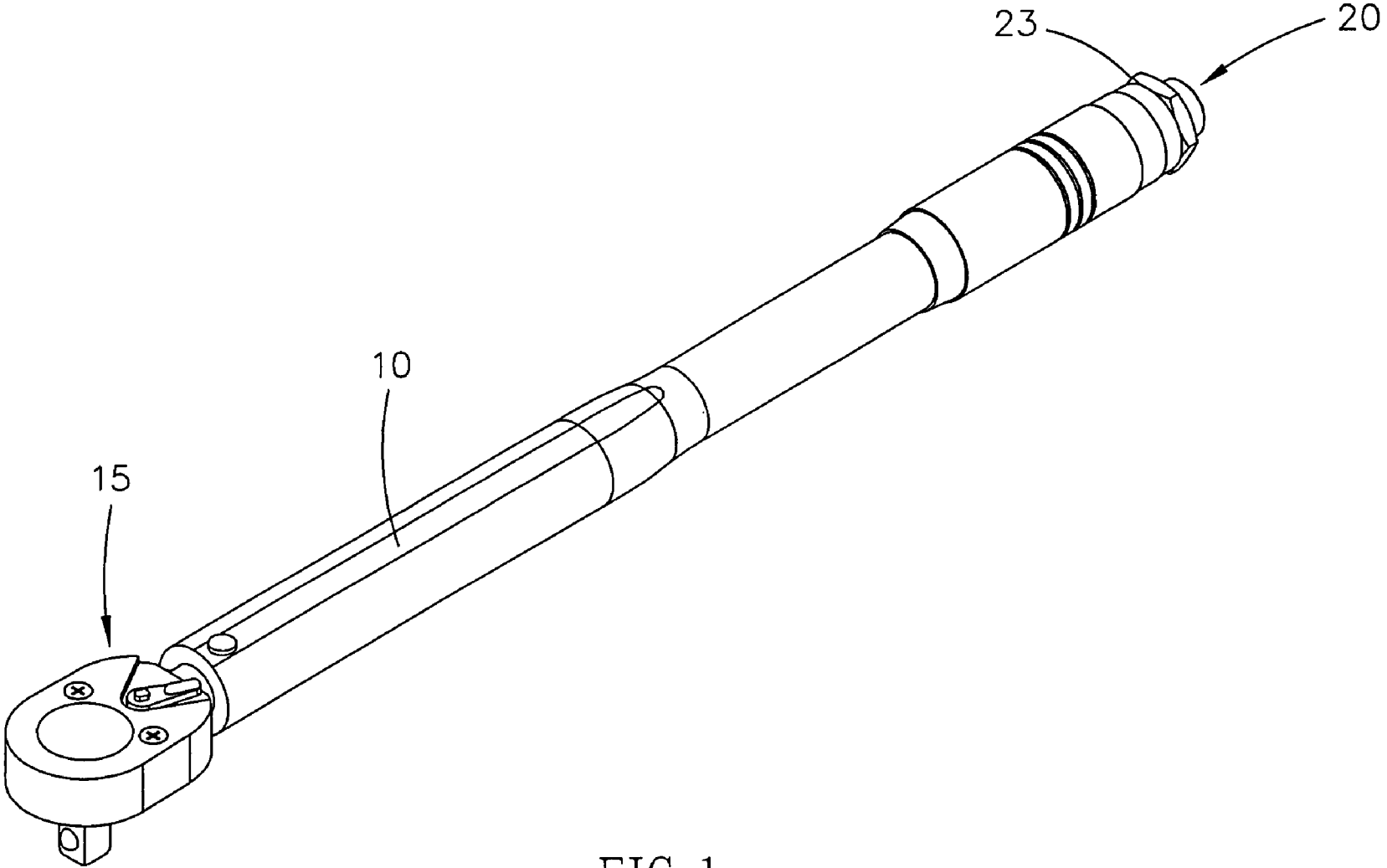
FIG.1 PRIOR ART
FIG. 1 is a perspective view of a conventional torque-controlling wrench.
Figure 2:
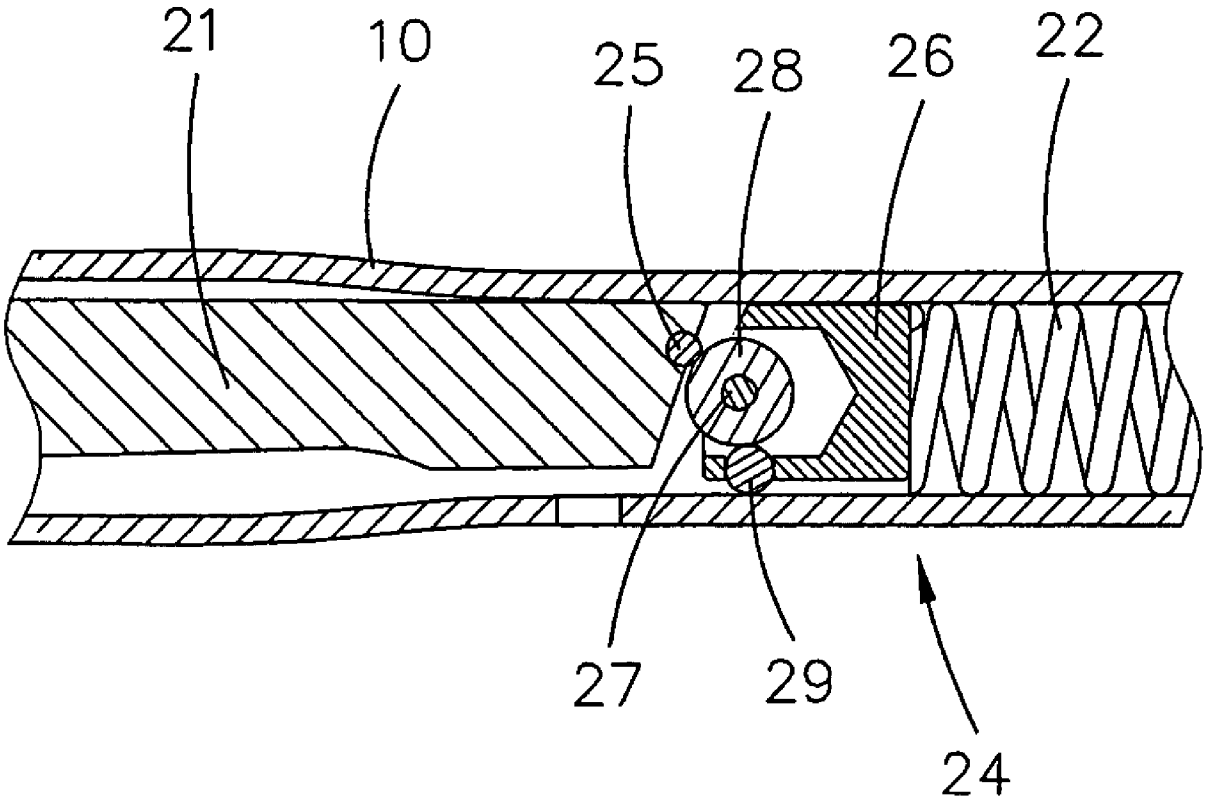
FIG.2 PRIOR ART
FIG. 2 is a cross-sectional partial view of the conventional torque-controlling wrench shown in FIG. 1.
Figure 3:
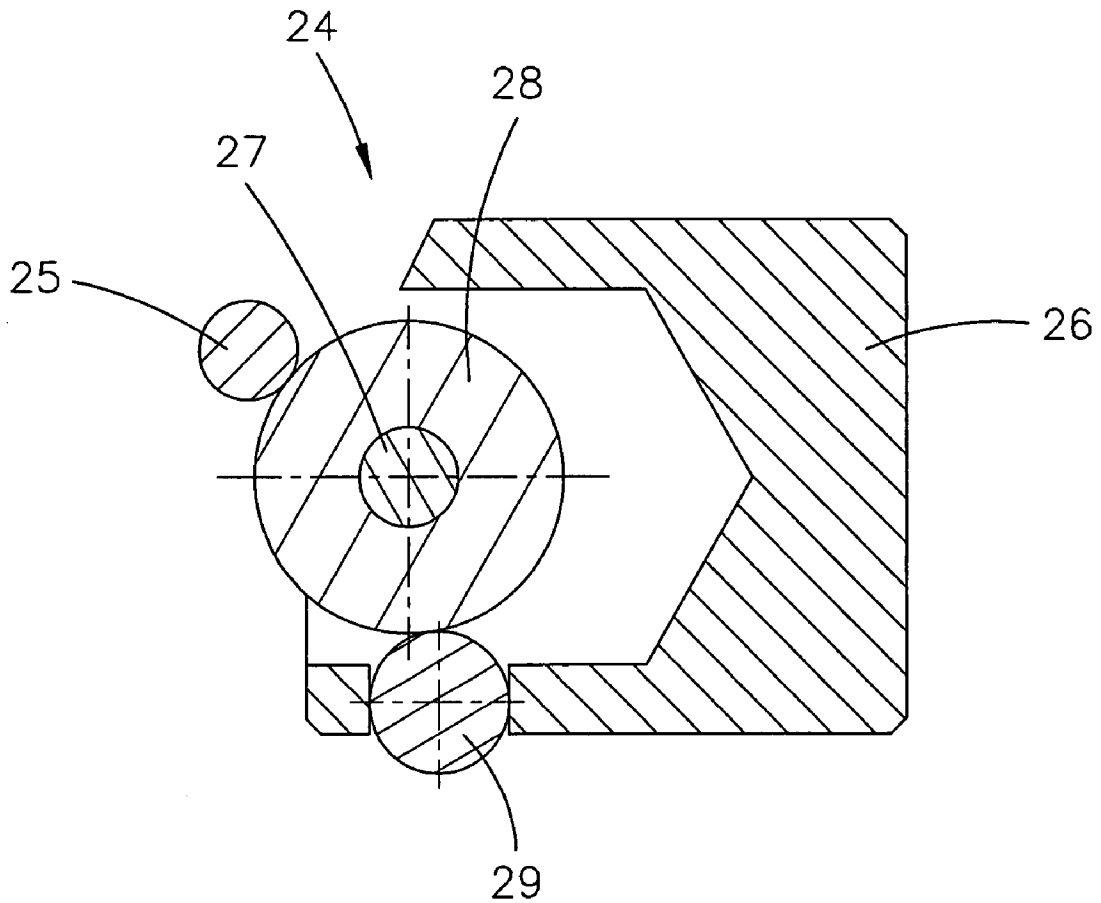
FIG. 3 PRIOR ART
FIG. 3 is a cross-sectional partial view of the conventional torque-controlling wrench shown in FIG. 2.
Figure 4:
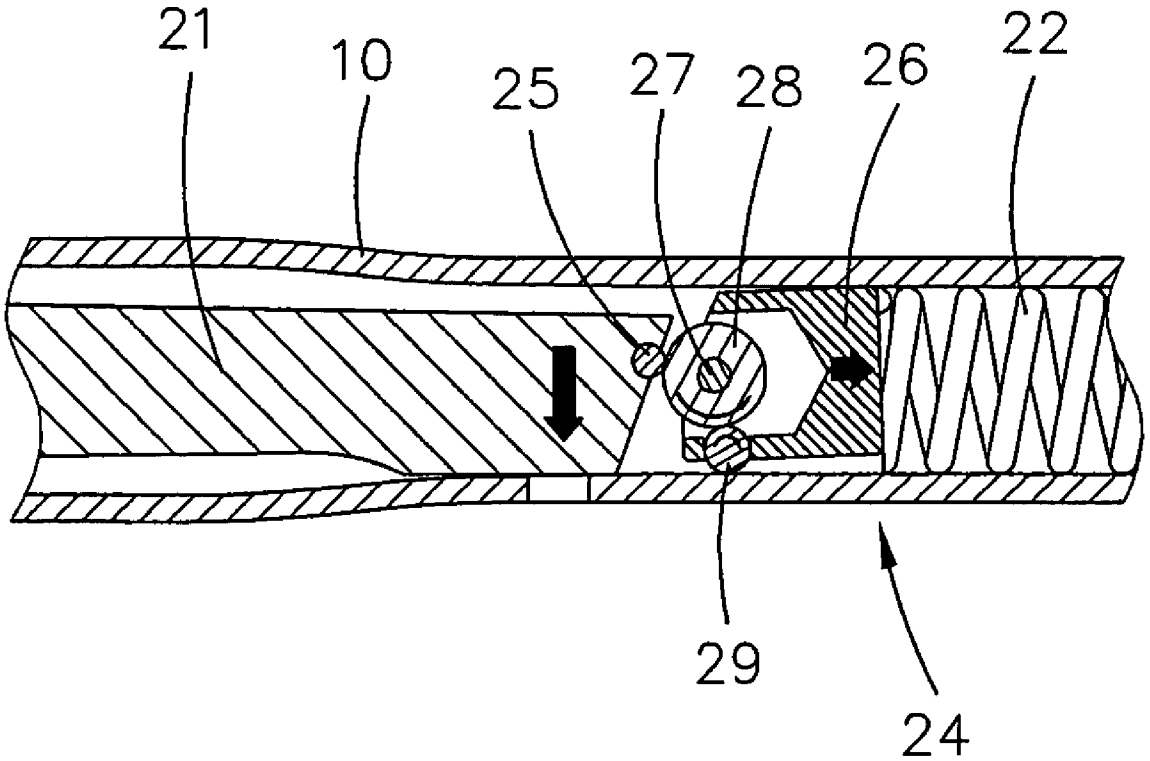
FIG. 4 PRIOR ART
FIG. 4 is a cross-sectional partial view of the conventional torque-controlling wrench in another position than shown in FIG. 2.
Figure 5:
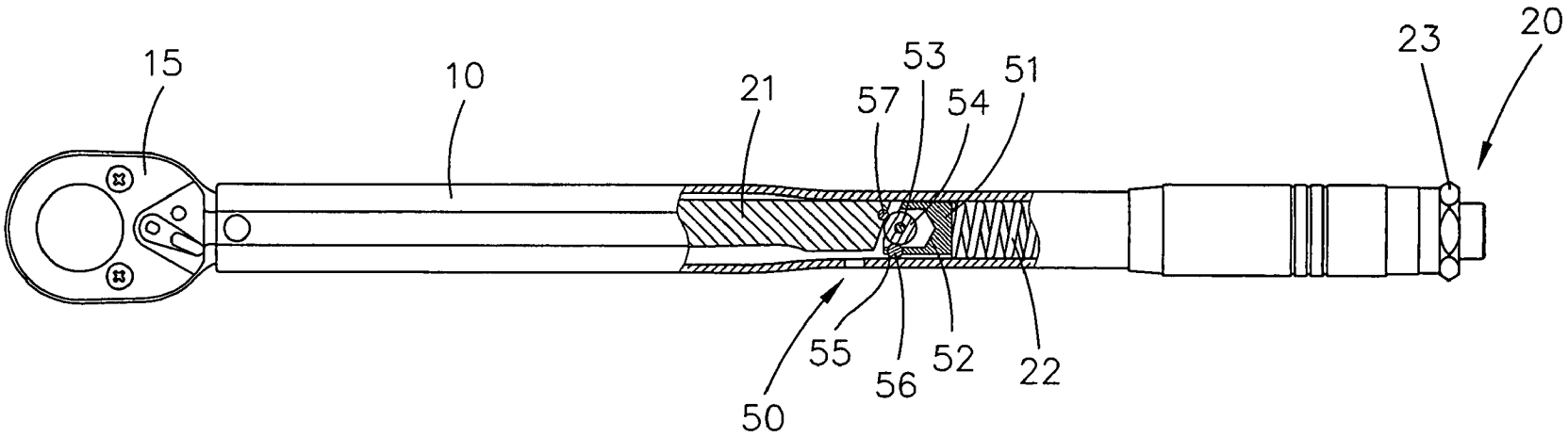
FIG. 5 is a perspective view of a torque-controlling wrench according to the preferred embodiment of the present invention.
Figure 6:
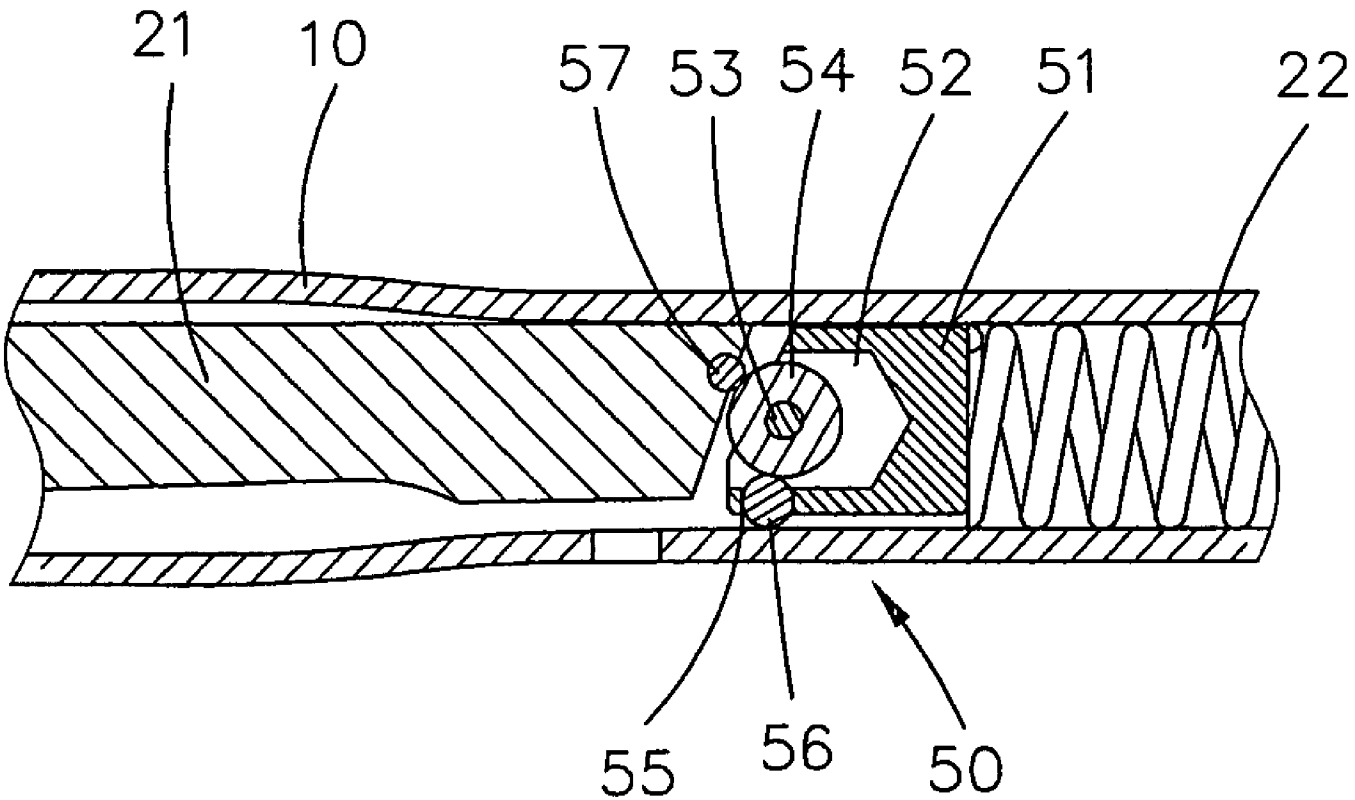
FIG. 6 is a cross-sectional partial view of the torque-controlling wrench shown in FIG. 5.

Referring to FIGS. 5 and 6, there is shown a torque-controlling wrench according to the preferred embodiment of the present invention. The wrench includes a handle 10 that is hollow, a socket-driving unit 15 installed at an end of the handle 10 and a torque-controlling device 20 installed in the handle 10 and connected to the socket-driving unit 15.

The torque-controlling device 20 includes a rod 21 connected to the socket-driving unit 15, a knob 23 installed at an opposite end of the handle 10 and a spring 22 compressed between the rod 21 and the knob 23 that can be turned to adjust the force exerted on the rod 21 by the spring 22.

For the stability and precision of the contact of the rod 21 with the spring 22, there is generally an intermediate mechanism 50. The intermediate mechanism 50 includes a roller 57 installed at an end of the rod 21 and a rolling gear installed at an end of the spring 22.

The rolling gear includes a frame 51 installed in the handle 10, a shaft 53 installed in a space 52 defined in the frame 51, a wheel 54 installed on the shaft 53 and a roller 56 installed in an aperture 55 defined in the frame 51. The wheel 54 is in contact with the roller 57 on one hand and in contact with the roller 56 on the other hand.

Figure 7:
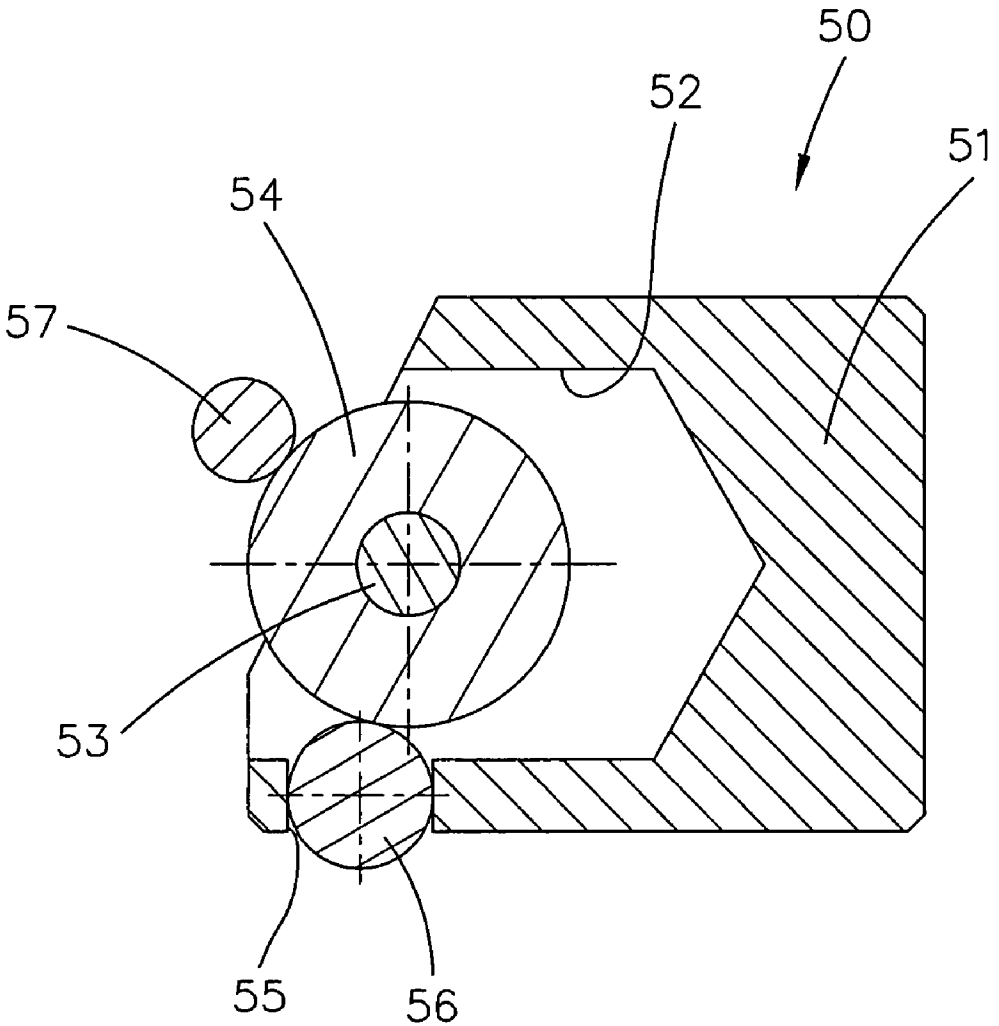
FIG. 7 is a cross-sectional partial view of the torque-controlling wrench shown in FIG. 6.

Referring to FIG. 7, the center of the roller 57 and the center of the roller 56 are located on a same side of a vertical line passing the center of the shaft 53 or the wheel 54.

Figure 8:
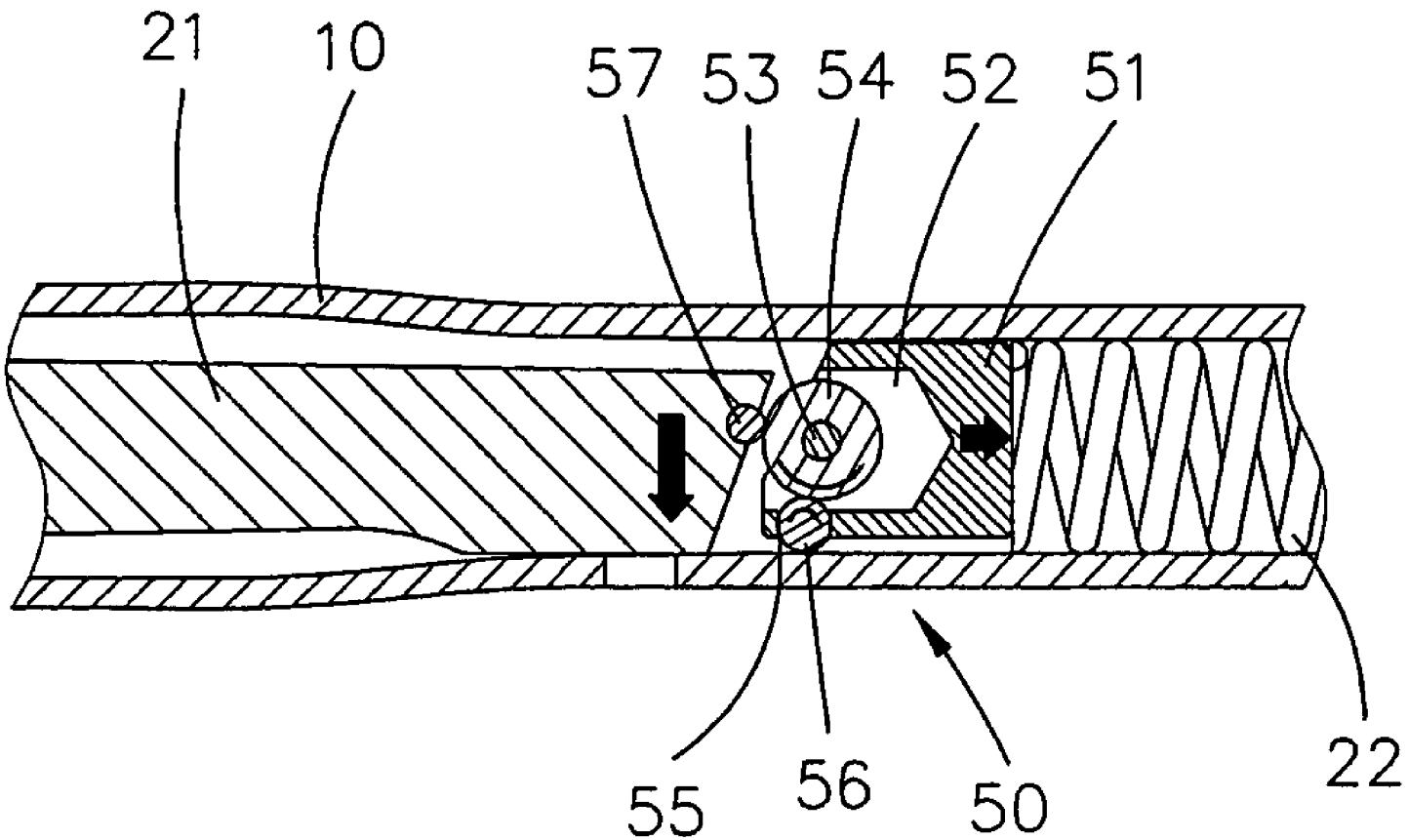
FIG. 8 is a cross-sectional partial view of the torque-controlling wrench in another position than shown in FIG. 6.

Referring to FIG. 8, when torque exerted on a fastener by the torque-controlling wrench reaches a pre-determined value, the rod 21 will be moved downwards. The movement of the rod 21 does not cause the pivoting of the frame 51 for reasons. Firstly, as in the prior art, both of the roller 57 and the wheel 54 are expected to roll smoothly. Secondly, a downward force exerted on the wheel 54 by the roller 57 would be encountered by an upward force exerted on the wheel 54 by the roller 56 without causing the pivoting of the frame 51 since they occur on the same side of the vertical line passing the center of the shaft 53. Should the roller 57 and the wheel 54 not roll as smoothly as expected, the movement of the rod 21 would not result in the pivoting of the frame 51. Since the frame 51 cannot be pivoted, the spring 22 will be compressed for interrupting the driving of the fastener by the torque-controlling wrench as expected.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A torque-controlling wrench comprising a handle, a socket-driving unit installed on the handle and a torque-controlling device comprising:

a rod installed in the handle and connected to the socket-driving unit;

a knob installed on the handle;

a spring compressed between the rod and the knob so that the knob can be turned to adjust a force exerted on the rod by the spring; and an intermediate mechanism comprising a first roller connected to the rod, a frame connected to the spring, a wheel installed on the frame and engaged with the roller and a second roller installed on the frame and engaged with the wheel, wherein the centers of the first and second rollers are located on a same side of a vertical line passing the center of the wheel, wherein as a torque exerted on a fastener by the wrench reaches a pre-determined value, the rod is moved vertically and horizontally relative to the handle, and a downward force exerted on the wheel by the first roller is encountered by an upward force exerted on the wheel by the second roller without causing the pivoting of the frame.

2. The torque-controlling wrench according to claim 1 wherein the intermediate mechanism comprises a shaft for supporting the wheel on the frame.

3. The torque-controlling wrench according to claim 1 wherein the frame defines a space for receiving the shaft and a portion of the wheel.

4. The torque-controlling wrench according to claim 3 wherein the frame defines an aperture for receiving the second roller so that a portion of the second roller is engaged with a portion of the wheel in the space.

* * * * *